United States Patent [19]

Clemmer

[11] 4,331,334

[45] May 25, 1982

[54] GOLF BOARD GAME

[76] Inventor: Elmer R. Clemmer, 10520 Edison Way, North Hollywood, Calif. 91606

[21] Appl. No.: 192,242

[22] Filed: Sep. 30, 1980

[51] Int. Cl.[3] ..... A63F 3/00; A63F 7/06

[52] U.S. Cl. ..... 273/245; 273/87.2; 273/129 W; 273/281

[58] Field of Search ..... 273/245, 281, 145 R, 273/129 V, 129 W, 87 R, 87 C, 872, 87.4

[56] References Cited

U.S. PATENT DOCUMENTS 3,352,558 11/1967 Lucas ..... 273/245

3,658,339 4/1972 Boileau ..... 273/245

3,912,270 10/1975 Trossman et al. ..... 273/245 X

*Primary Examiner*—Richard C. Pinkham

*Assistant Examiner*—Scott L. Brown

[57] ABSTRACT

A board game for imitating an actual golf game, including a board, upon which there is printed a three hole golf course, several playing pieces for movement upon the golf course, a single die printed with only one to three dots, and score cards for keeping scores of the players, and the gameboard, in one design thereof, including a foldout golf club, for hitting the die.

1 Claim, 6 Drawing Figures

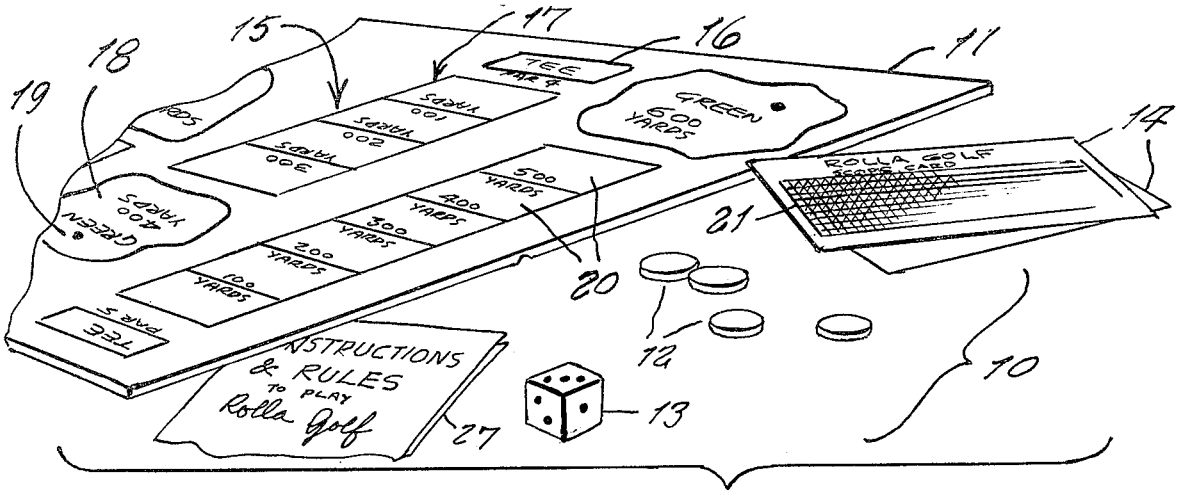
Fig. 1
Fig. 2
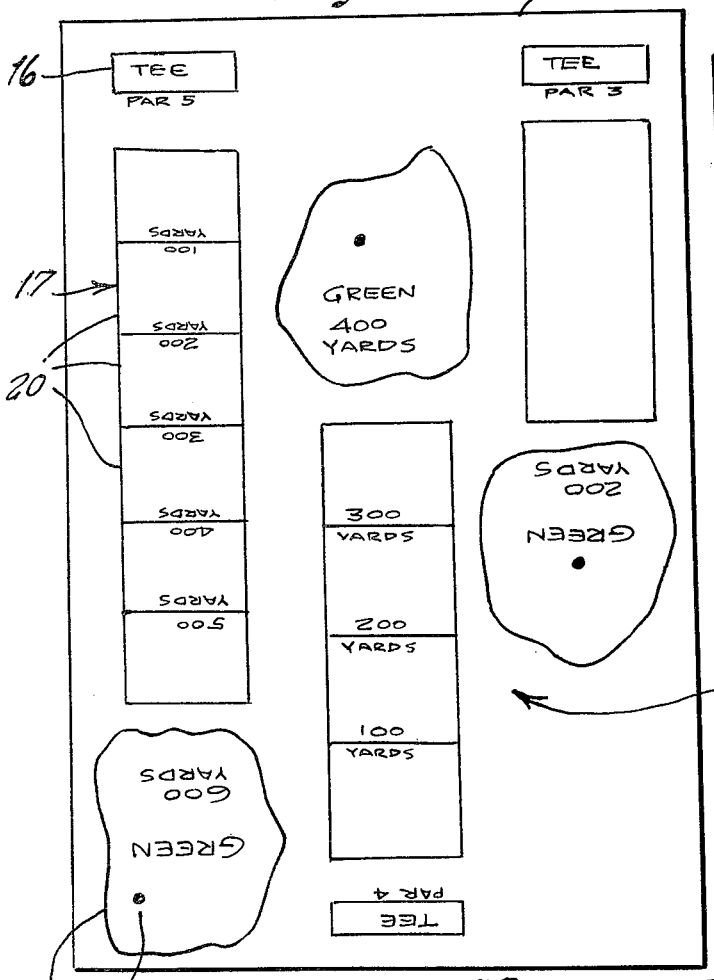
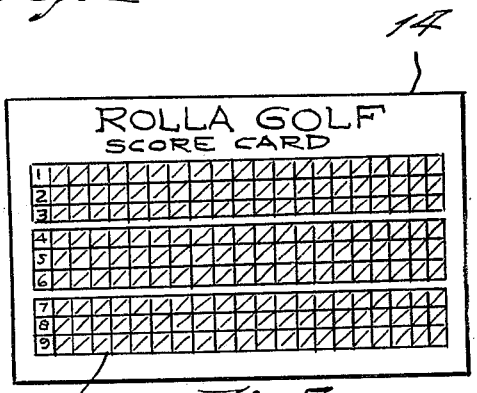
Fig. 3
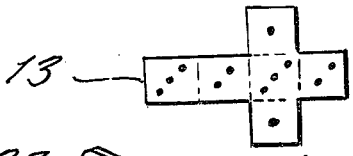
Fig. 4
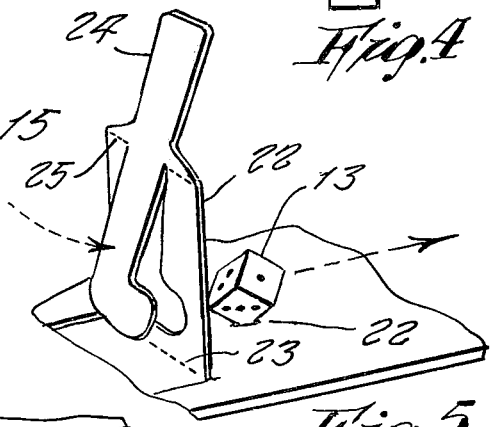
Fig. 5
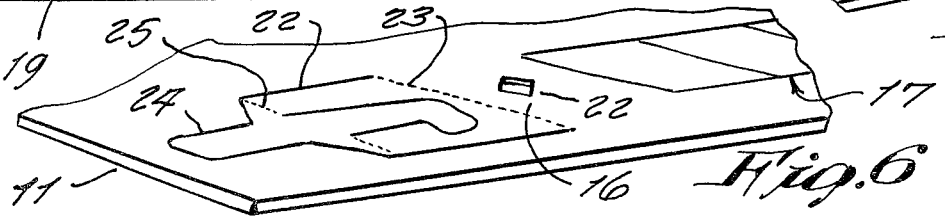
Fig. 6

GOLF BOARD GAME

This invention relates generally to board games, such as include a gameboard, upon which playing pieces are moved.

A principal object of the present invention is to provide a board game, which imitates an actual game of golf, so as to give players, using their imagination, some of the thrills and pleasures of the actual game.

Another object is to provide a Rolla Golf game, which may be played competitively among several players, so that all can participate in enjoying it, and which is not complicated to play, so that it may be played by both adults and children, as well as all who are confined indoors, away from participation in physical activity.

Other objects of the present invention are to provide a Rolla Golf game, which is simple in design, inexpensive to manufacture, rugged in construction, easy to use and efficient in operation.

These, and other objects, will be readily evident upon a study of the following specification and the accompanying drawing wherein:

FIG. 1 is a perspective view of the game components;

FIG. 2 is a top view of the gameboard;

FIG. 3 is a face view of a score card of the game;

FIG. 4 is a layout of the facets of the die;

FIG. 5 is a detail of another design of gameboard, which includes a foldable golf club for hitting the die, so that the game additionally includes one more feature of a real golf game; and FIG. 6 shows the golf club folded down, so that the gameboard can be stored away.

Referring now to the drawing in greater detail, the reference numeral 10 represents a Rolla Golf game, according to the present invention, wherein there is a foldable gameboard 11, which is of a size so that it may be conveniently placed upon a table, for use during a game, a plurality of playing pieces 12, for movement upon the gameboard, a single die 13, for determining the playing distance of the pieces upon the board, and score cards 14, for keeping scores of the players.

The gameboard has a playing field 15, printed upon one side thereof, that comprises a three hole golf course, each hole thereof including a tee-off area 16, a fairway 17, and a green 18 with golf ball hole 19 printed within its boundary. The fairways are divided into playing spaces 20, each one of which represents one hundred yards. Each green represents an additional playing space, by being marked with an additional one hundred yards.

The three hole course is indicated with a par three, par four and a par five.

Each of the playing pieces comprises a flat circular disc, of suitable size for fitting in the playing spaces of the playing field. There are four such discs, each of a different color.

The die is a six-sided cube, each face of which is marked with either a single dot, two dots or three dots, as shown in FIG. 4. It is to be noted, that each of these dot groups are repeated on two of the faces.

The score cards are each printed with a diagram 21. A first half thereof is for scoring strokes. A second half is for scoring putts.

As shown in FIGS. 5 and 6, the gameboard may include a fold-out 22, on its upper side, that can be pivoted, about fold line 23, into a vertically raised position, and which includes a die cut-out of a golf club 24, that is pivotable about a fold line 25, so as to be used for hitting the die when teed up before it (as shown in FIG. 5), with one corner of the die fitted in a depression 26 of the gameboard, so that, when hit by the club, the die rolls upon the gameboard surface, for determining the playing distance for a piece 12.

The game may also include a booklet or leaflet 27 containing instructions and rules for playing the game. These instructions and rules are as follows:

Par Three: Two hundred yards. Each player in turn gets one roll of the dice to make the green. The players that roll a two are on the green in one stroke. The players that roll a one or three missed the green, so they take an extra stroke, and they are on the green in two strokes. After all players have landed on the green, each player takes one roll of the dice for putts 1, 2 or 3 putt.

Par Four: Four hundred yards. Each player in turn gets two rolls of the dice to make the green. The players that roll a four in two rolls are on the green in two strokes. The players that do not roll a four in two rolls missed the green, so they take an extra stroke, and they are on the green in three strokes. After all players have landed on the green, each player takes one roll of the dice for putts 1, 2 or 3 putt.

Par Five. Six hundred yards. Each player in turn gets three rolls of the dice to make the green. The players that roll a six in two rolls are on the green in two strokes. The players that roll a six in three rolls are on the green in three strokes. The players that do not roll a six in three rolls missed the green, so they take an extra stroke, and they are on the green in four strokes. After all players have landed on the green, each player takes one roll of the dice for putts 1, 2 or 3 putt.

The number of holes to play should be decided at the start of the game. Any number of holes can be played—9, 18, 36 and so on. After three holes are played, go back and start over again, and so on.

You can play stroke play, or pair up and play best ball. If there is a tie, go back and play sudden death.

While various changes may be made in the detail construction, it is understood that such changes will be within the spirit and scope of the present invention, as is defined by the appended claims.

What I now claim is:

1. A golf game, comprising, in combination, a gameboard, a plurality of playing pieces for movement upon said gameboard, a die for determining the travel distance of said playing pieces on said gameboard, means on said gameboard for hitting said die, score cards for keeping players' scores, and an instructions booklet for playing said game; a three hole golf course being printed on said gameboard; and said die-hitting means comprising a fold-out on an upper side of said gameboard, said fold-out being upwardly foldable about a fold line at a base thereof, a cut-out of a golf club on said fold-out, said golf club being pivotable about a horizontal fold line on said fold-out; a depression on said gameboard into which a corner of said die is fitted, said depression being located a distance respective to said fold-out, so that said golf club hits said die when said fold-out is upwardly folded and said golf club is pivoted.

* * * * *